US007775397B2

(12) United States Patent
Rivard et al.

(10) Patent No.: US 7,775,397 B2
(45) Date of Patent: Aug. 17, 2010

(54) AUTOMATIC VALVE ASSEMBLY FOR A WATER COOLER RESERVOIR

(75) Inventors: Dennis Rivard, St. Alberta (CA); Zhendong Liu, Shekou Shenzhen (CN); Fan Kun, Shekou Shenzhen (CN)

(73) Assignee: Denfred Holdings, Ltd., Edmonton, Alberta (CA)

( * ) Notice: Subject to any disclaimer, the term of this patent is extended or adjusted under 35 U.S.C. 154(b) by 463 days.

(21) Appl. No.: 11/701,482

(22) Filed: Feb. 2, 2007

(65) Prior Publication Data

US 2007/0131709 A1 Jun. 14, 2007

Related U.S. Application Data

(63) Continuation of application No. 29/238,412, filed on Sep. 16, 2005, now Pat. No. Des. 566,810, which is a continuation of application No. 10/791,769, filed on Mar. 4, 2004, now Pat. No. 7,051,902.

(30) Foreign Application Priority Data

Mar. 13, 2003 (CA) ..... 2421801

(51) Int. Cl.
*B67D 1/00* (2006.01)
*B65B 1/04* (2006.01)

(52) U.S. Cl. ..... 222/69; 222/185.1; 141/303

(58) Field of Classification Search ..... 222/64, 222/67, 69, 62, 146.1, 146.6, 146.5, 146.2, 222/185.1, 481.5; 141/303, 304
See application file for complete search history.

(56) References Cited

U.S. PATENT DOCUMENTS 1,706,631 A 3/1929 O'Brien
2,105,078 A * 1/1938 Hill ..... 137/99.5
2,156,834 A * 5/1939 Berry ..... 221/96

(Continued)

FOREIGN PATENT DOCUMENTS

DE 1078891 3/1960

(Continued)

OTHER PUBLICATIONS

International Search Report issued in connection with International Application No. PCT/CA2004/000315.

(Continued)

*Primary Examiner*—Kevin P Shaver
*Assistant Examiner*—Stephanie E Tyler
(74) *Attorney, Agent, or Firm*—Merek, Blackmon & Voorhees, LLC

(57) ABSTRACT

An automatic valve assembly for a water cooler having a reservoir of the type that has its upper end generally sealed to the atmosphere by a water bottle adapter that receives and supports an inverted water bottle. The valve assembly includes a ventilation passageway providing for air to enter the reservoir, and an actuator arm hingedly mounted within the interior of the water cooler. The actuator arm is operable to move between an open and a closed position in response to changing water levels within the reservoir. When in its open position the actuator arm allows the unrestricted passage of air into the reservoir through the ventilation passageway. When in its closed position the actuator arm restricts the flow of air and fluids through the ventilation passageway.

25 Claims, 6 Drawing Sheets

U.S. PATENT DOCUMENTS

| | | | | |
|---|---|---|---|---|
| 2,239,921 | A | 4/1941 | Majewski | |
| 2,879,767 | A * | 3/1959 | Kulick | 604/246 |
| 3,572,553 | A * | 3/1971 | Ogden | 222/67 |
| D251,677 | S | 4/1979 | Johnson | |
| 4,757,921 | A | 7/1988 | Snowball | |
| 4,881,661 | A * | 11/1989 | Jones | 222/67 |
| 4,903,742 | A * | 2/1990 | Gagnon | 141/353 |
| 5,133,482 | A | 7/1992 | Burrows | |
| 5,172,831 | A | 12/1992 | Burrows | |
| 5,211,314 | A | 5/1993 | Burrows | |
| 5,323,832 | A | 6/1994 | Burrows | |
| D353,847 | S | 12/1994 | Kelsen | |
| 5,526,961 | A | 6/1996 | Burrows | |
| 5,577,638 | A | 11/1996 | Takagawa | |
| 5,611,459 | A | 3/1997 | Hinch | |
| 5,862,952 | A | 1/1999 | Lee | |
| D424,168 | S | 5/2000 | Higgins | |
| 6,190,549 | B1 | 2/2001 | Schwartz | |
| 6,540,111 | B2 | 4/2003 | Sunnarborg | |
| 6,588,630 | B2 * | 7/2003 | Tan et al. | 222/185.1 |
| 6,793,102 | B2 * | 9/2004 | Tan et al. | 222/185.1 |
| D502,225 | S | 2/2005 | Kotsonis | |
| 7,051,902 | B2 | 5/2006 | Rivard | |
| D566,810 | S | 4/2008 | Rivard | |
| 2002/0170921 | A1 | 11/2002 | Tan | |
| 2003/0071068 | A1 | 4/2003 | Burrows | |
| 2004/0040977 | A1 * | 3/2004 | Mathues | 222/1 |
| 2004/0178229 | A1 | 9/2004 | Rivard | |
| 2005/0229299 | A1 | 10/2005 | Balding | |

FOREIGN PATENT DOCUMENTS

| | | |
|---|---|---|
| JP | 1-193070 | 8/1989 |
| JP | 2-25784 | 2/1990 |
| JP | 3-110286 | 11/1991 |
| JP | 8-509942 | 10/1996 |

OTHER PUBLICATIONS

International Preliminary Report on Patentablity issued in connection with International Application No. PCT/CA2004/000315.

Written Opinion of the International Searching Authority issued in connection with International Application No. PCT/CA2004/000315.

Office Action issued by State Intellectual Property Office of People's Republic of China in connection with Application No. 200480006782.4.

Canadian Patent Office Action dated Oct. 14, 2008 issued in connection with Application No. 3,421,801.

Indonesian Office Action issued in connection with Application No. W-00200502433; with the English language translation thereof.

Jan. 19, 2010 Office Action issued by Japanese Patent Office in Patent Application No. 2006-529473 with English language translation.

Oct. 2, 2008 Office Action issued by the European Patent Office on Application No. 04761563.8-2316.

Dec. 18, 2009 Office Action issued by the India Patent Office on Application No. 1771/KOLNP/2005.

Jul. 17, 2009 Office Action issued by State Intellectual Property Office of People's Republic of China on Application No. 200480006782.4.

* cited by examiner

AUTOMATIC VALVE ASSEMBLY FOR A WATER COOLER RESERVOIR

RELATED APPLICATIONS

The subject patent application is a continuation of and claims priority under 35 USC §120 from U.S. patent application Ser. No. 29/238,412 filed on Sep. 16, 2005 now U.S. Pat. No. Des. 566,810 which is a continuation of U.S. patent application Ser. No. 10/791,769 filed on Mar. 4, 2004, now U.S. Pat. No. 7,051,902. The entire contents of U.S. patent application Ser. No. 29/238,412 filed on Sep. 16, 2005 and U.S. patent application Ser. No. 10/791,769 filed Mar. 4, 2004 are incorporated herein by reference.

FIELD OF THE INVENTION

This invention relates to an automatic valve assembly for a water cooler reservoir, and in particular a valve assembly to assist in the interruption of the flow of water from an inverted water bottle mounted upon a sealed water cooler reservoir.

BACKGROUND OF THE INVENTION

The basic design of a water cooler is well known. With an increasing level of concern over the safety of much of the world's drinking water, the utilization of bottled water as a source of water for drinking, cooking and other applications has increased tremendously. Along with the increase in the use of bottled water there has been a significant advance in the design of water coolers and their component parts. For example, whereas initially such appliances were merely capable of dispensing water from an inverted bottle, today they commonly provide water that is chilled, heated and/or dispensed at room temperature. Further, others have developed a variety of different water bottle caps and mounting adapters to support bottles upon coolers that help to prevent spillage of water when inverting a filled bottle and placing it upon the bottle support structure. Still others have created structures that assist in sealing the cooler in order to limit or prevent the ingress of dirt and other debris that may contaminate water stored in the reservoir (see, for example, U.S. Pat. Nos. 6,167,921, 5,526,961, and 5,646,127 as representative examples of such devices).

While much has been accomplished in the design of water coolers to help prevent the contamination of water stored in the reservoir and to assist consumers in placing an inverted bottle onto the top of the cooler, little effort has been directed at a recurring problem that occurs when a bottle develops a small hairline crack or fracture in its outer surface. For obvious cost and weight benefits, most water bottles are formed from a relatively thin plastic material. When in use on a water cooler, the pressure differentials that the bottles are subjected to typically result in a flexing of the walls of the bottle, inwardly and outwardly as water is delivered to the reservoir and air is returned to the bottle. This flexing process can serve as a means by which small cracks or fractures in the bottle may develop over time. Even where a bottle shows no sign of leakage, when inverted and placed upon a cooler at some point during its use the bottle may develop a small crack or hole. The increased use of bottled water tends to exacerbate the problem since water bottles are continuously re-filled and re-used to the point that eventually they are prone to developing cracks in their side walls.

In the situation where an inverted filled bottle has or develops a small fracture or crack in its surface, the fracture presents an avenue by which air may enter the bottle, which in turn may cause the contents of the bottle to overflow the reservoir and spill onto the floor or surrounding surface area. In some instances the volume of water that can overflow the reservoir may be in the nature of a few gallons, which can cause substantial damage to flooring, furniture, and other surrounding items.

In an effort to combat this problem, others have incorporated within the reservoirs of water coolers small floats or bobbers that are meant to help reduce the flow of air into the reservoir. By reducing or slowing the flow of air into the otherwise sealed reservoir there is presented a means to at least partially control the flow of water from the bottle. Unfortunately, such existing devices are to a large extent ineffective in situations where a bottle develops a relatively small fracture that permits its contents to slowly be drained into the reservoir. That is, such existing devices tend to be somewhat effective in situations where there has been a significant breach in the wall of a water bottle but generally do not have the ability to positively and completely seal the reservoir air passageway where water slowly drains from a bottle that has developed a fine crack or fracture. Such prior devices also tend to be prone to becoming misaligned and may have a diminished effectiveness in situations where the water cooler is not vertically oriented.

SUMMARY OF THE INVENTION

The invention therefore provides an automatic valve assembly for a water cooler reservoir that assists in controlling the downward flow of water from an inverted water bottle into the reservoir through the provision of an enhanced and improved mechanism to control the flow of air into the reservoir, and to thus help prevent the flow of water from the bottle when the reservoir is filled to its capacity.

Accordingly, in one of its aspects the invention provides an automatic valve assembly for a water cooler having a reservoir of the type that has its upper end generally sealed to the atmosphere by a water bottle adapter that receives and supports an inverted water bottle, the valve assembly comprising a ventilation passageway providing a means for air to enter said reservoir; and, an actuator arm hingedly mounted within the interior of said water cooler and operable to move between an open and a closed position in response to changing water levels within said reservoir, when in said open position said actuator arm allowing the unrestricted passage of air into said reservoir through said ventilation passageway and when in said closed position said actuator arm restricting the flow of air and fluids through said ventilation passageway.

In a further aspect the invention provides an automatic valve assembly for a water cooler reservoir, the valve assembly comprising a ventilation passageway providing a means for air to enter said reservoir, said ventilation passageway comprising a conduit having a lower end terminating within said reservoir; an actuator arm hingedly mounted within said reservoir, said actuator arm comprising a float that is operable to move between an open and a closed position in response to changing water levels within said reservoir; and, a sealing element positioned upon said actuator arm adjacent said lower end of said conduit such that when said actuator arm is in said open position said sealing element is withdrawn from said lower end of said conduit, when said actuator arm is in said closed position said sealing element is driven into contact with said lower end of said conduit and restricts the flow of air and fluids through said ventilation passageway.

In another aspect the invention provides an automatic valve assembly for a water cooler having a reservoir of the type that has its upper end generally sealed to the atmosphere by a water bottle adapter that receives and supports an inverted water bottle, the valve assembly comprising an actuator arm positioned within said reservoir and hingedly mounted to said water bottle adapter, said actuator arm comprising a float that is operable to move between an open and a closed position in response to changing water levels within said reservoir; and, a ventilation passageway providing a means for air to enter said reservoir, said ventilation passageway comprising a conduit having a lower end terminating within said reservoir, said lower end of said conduit comprised of a resilient compressible material that is at least partially compressed by said actuator arm upon said actuator arm moving to said closed position to thereby restrict the flow of air and fluids through said ventilation passageway.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
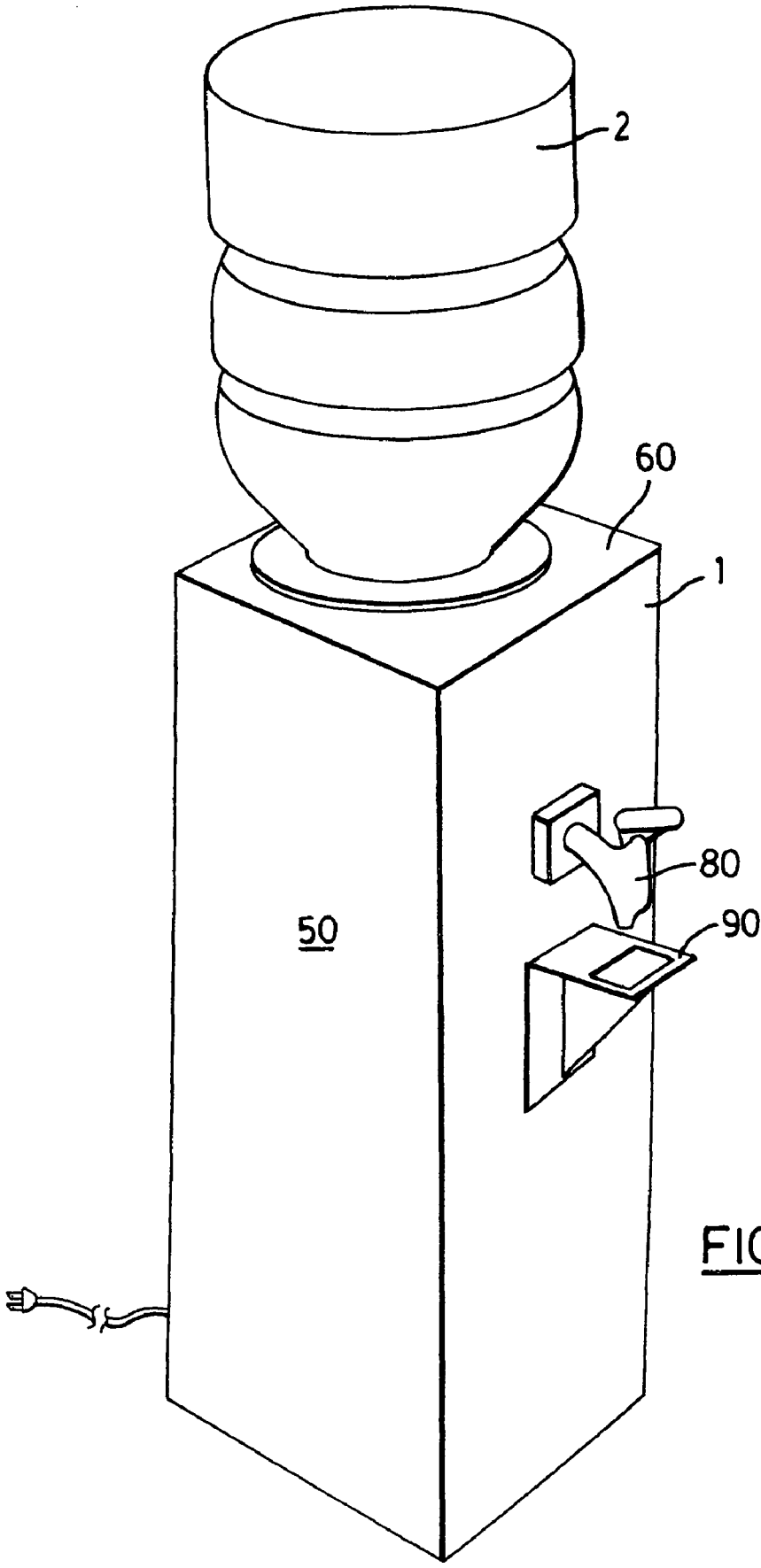
FIG. 1 is a side perspective view of a water cooler.
Figure 2:
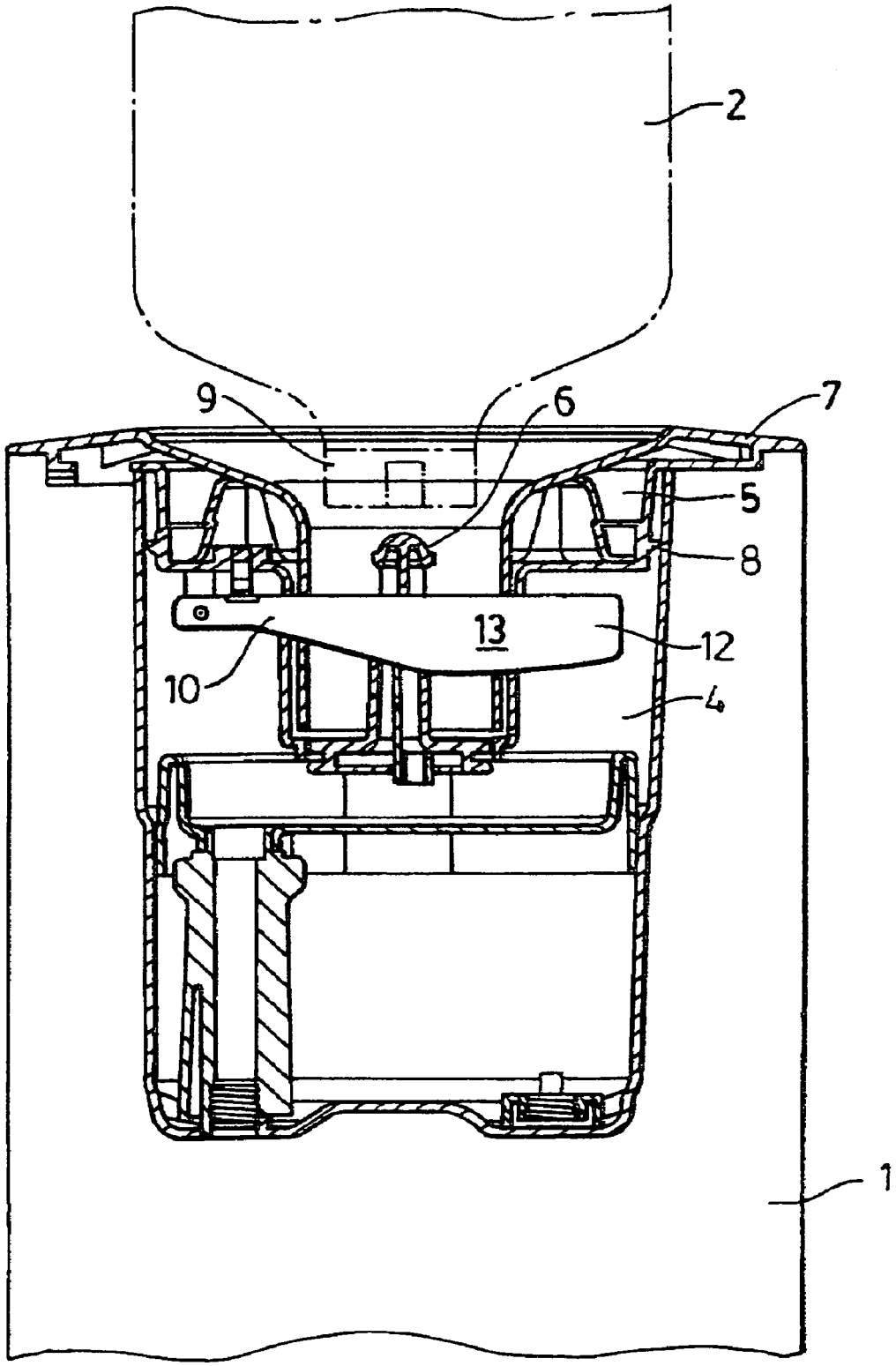
FIG. 2 is a partial vertical sectional view through the water cooler of FIG. 1 showing an embodiment of the automatic valve assembly of the present invention in its closed position.
Figure 3:
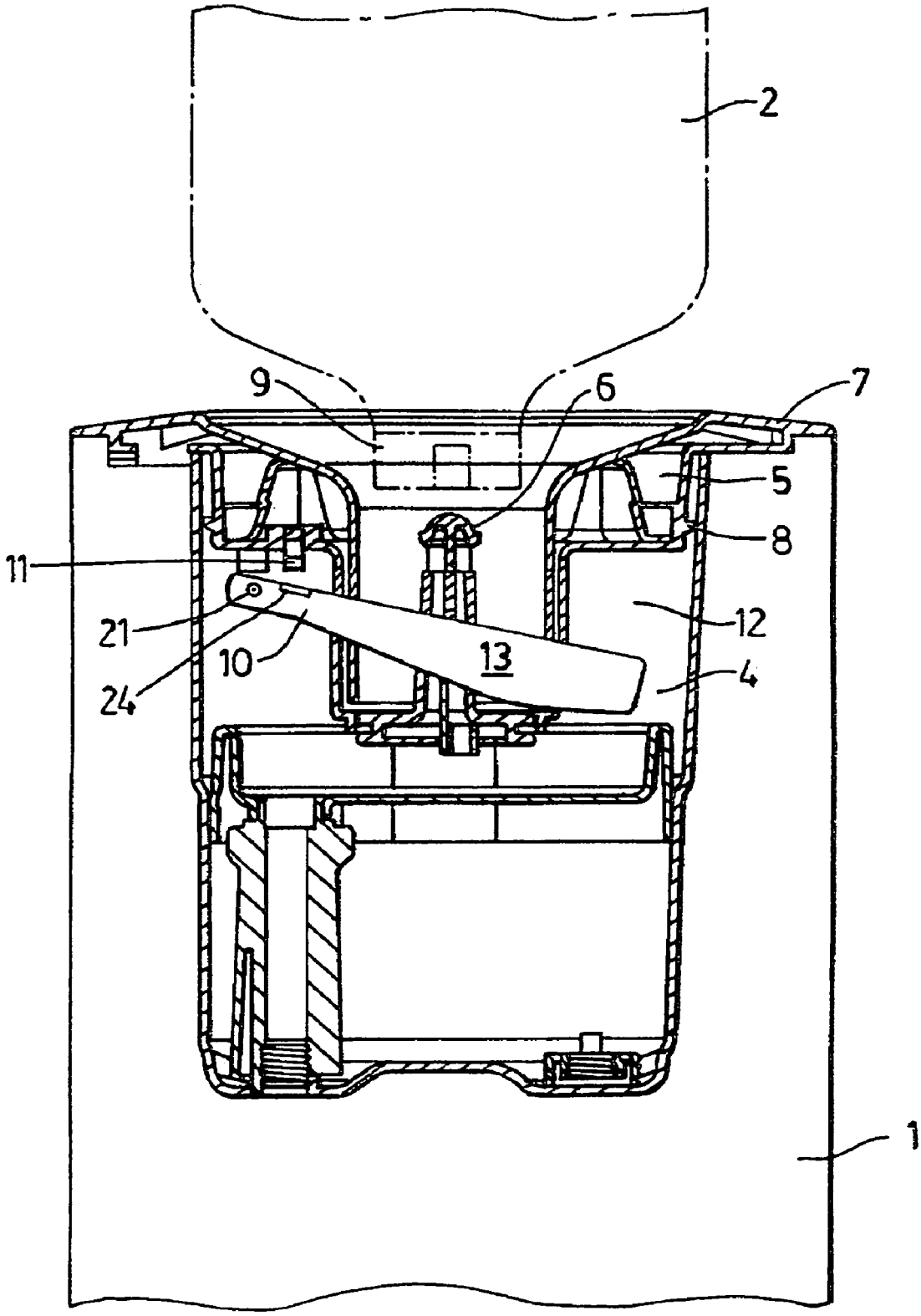
FIG. 3 is a partial vertical sectional view through the water cooler of FIG. 1 showing an embodiment of the automatic valve assembly of the present invention in an open position.

In the attached drawings, FIGS. 1, 2 and 3 generally show the primary components of a water cooler 1 of the type designed for receiving an inverted water bottle 2 (shown in ghost outline in FIGS. 2 and 3). Since many of the features of a standard water cooler are not directly relevant to the present invention, they have not been shown in the attached Figures, or in other instances may be shown but are not specifically discussed.

In FIG. 1, water cooler 1 is shown as comprised generally of an outer cabinet 50 having a top 60 adapted for receiving and supporting an inverted water bottle 2. Positioned on the front surface of cabinet 50 there will typically be one or more valves or spigots 80 that are activated to dispense water from the cooler. The number of valves that are utilized is dependent upon whether the cooler has the capacity to dispense chilled and/or heated water in addition to room temperature water. A drip tray 90 is often positioned below valve 80 in order to collect any drips or spillage that may occur when the valve is activated.

Referring to FIGS. 2 and 3, water cooler 1 also includes a reservoir 4, a water bottle adapter 5, a bottle cap engaging probe or pin 6, and an upper cover ring 7. The overall structure and construction of these primary components of cooler 1 are not unlike those that have been in use for a considerable length of time. Reservoir 4 is constructed with a generally open upper end that is generally sealed to the atmosphere by water adapter 5. In the specific embodiment shown, water bottle adapter 5 includes a circumferential lip seal 8 that bears against the interior surface of the reservoir housing when the adapter is received into the open upper end of the reservoir. Access to the reservoir is then restricted to the flow of water through bottle cap engaging pin 6 and through an air or ventilation passageway, both of which are discussed below in greater detail.

As is standard in many water coolers, water bottle adapter 5 has a conical or funnel-like shape and is designed to receive and support bottle 2 in an inverted orientation such that water within the bottle may be gravity fed into reservoir 4. Typically water bottles for use in association with coolers utilize a cap 9 that encloses their open ends and that provides a means to allow water to be dispensed from the bottle when inverted, while at the same time helping to prevent the spillage of water when inverting a water bottle and placing it into adapter 5. These caps also present a mechanism for re-sealing the bottle upon its removal from the cooler. That function is accomplished through the utilization of a particular cap design that incorporates an internal valve that co-ordinates with bottle cap engaging pin or probe 6. As the inverted bottle is lowered into water bottle adapter 5, pin 6 is received through bottle cap 9, effectively opening the valve within the cap and allowing water to pass through pin 6 and into reservoir 4. Although a further understanding of the structure and function of bottle cap 9 and bottle cap engaging pin 6 is unnecessary for a complete understanding of the present invention, reference maybe made to Canadian patent 2,093,006, dated Dec. 8, 1998, as a resource document that more fully describes the operation of the bottle cap and pin mechanisms.

Traditionally, water coolers of the type generally described above have permitted water to flow downwardly from an inverted bottle placed upon the cooler until the level of water in the reservoir reached a height at which air ceased to flow or gurgle back into the bottle. At that point the flow of water from the bottle into the reservoir was effectively stopped. As water was drawn from the cooler through valve 80 the level of water within the reservoir dropped and the flow of water from the bottle into the reservoir was re-established. To permit the flow of air into the reservoir (and ultimately back into the water bottle) the water bottle adapters of prior existing coolers commonly contained one or more air passageways extending therethrough. Such passageways presented a mechanism to allow for air to flow into and out of the reservoir the reservoir as the level of water went up or down.

Such systems relied upon the sides of the water bottle to remain in tact so that air could only be drawn into the bottle through pin 6. In this manner, as water was drawn from the bottle and the level of water within the reservoir rose to a sufficient degree the vacuum condition created within the interior of the bottle effectively offset the hydraulic head of the water and prevented further downward flow into the reservoir. Unfortunately, as discussed above, bottle fatigue sometimes results in small holes or cracks developing in the sides of the bottle, permitting atmospheric air to be drawn directly into the bottle. When that occurs the equilibrium condition that prevents further downward flow of water no longer exists allowing the contents of the bottle to drain completely into the reservoir, often causing the reservoir to overflow.

To prevent the above situation, in a preferred embodiment the present invention comprises an automatic valve assembly 10 that includes a ventilation passageway 11 and an actuator arm 12. Actuator arm 12 includes at least one float 13 and is hingedly mounted within reservoir 4 such that the raising or lowering of the water level within the reservoir causes the actuator arm to pivot and rotate in a generally vertical plane relative to the reservoir. Ventilation passageway 11 is comprised of a conduit that extends through water bottle adapter 5 and has a lower end 14 terminating within the reservoir to provide a means for air to flow into or out of the reservoir as required. To prevent dust, dirt and other debris from being drawn into the reservoir, in a preferred embodiment of the invention the upper end 16 of ventilation passageway 11 is fitted with a filter cap that contains a replaceable or washable filter material.

In the particular embodiment of the invention shown in FIGS. 2 and 3, ventilation passageway 11 and actuator arm 12 are positioned so that the pivotal movement of actuator arm 12 is in a generally upward direction such that when raised, the actuator arm will eventually come into contact with lower end 14 of ventilation passageway 11. When the arm contacts lower end 14 it will effectively block the flow of air and fluids into and out of reservoir 4. Since actuator arm 12 preferably includes at least one float 13, it will be appreciated that the upward rotational movement of the arm will be caused by a rising water level within the reservoir. That is, as water passes from bottle 2 through pin 6 and into reservoir 4, the rising water level will cause actuator arm 12 to rotate upwardly and seal against lower end 14 of ventilation passageway 11. At that point there can be no movement of air or fluids through the ventilation passageway.

It will thus be appreciated that through the combination of the sealing of ventilation passageway 11, and through sealing the upper end of the reservoir with the use of lip seal 8, there will be no way for make-up air to be drawn into the reservoir preventing any further flow of water from bottle 2. The flow of water will effectively be stopped, even in instances where the sidewalls of water bottle 2 develop small holes or fractures that allow air to be drawn into the bottle. Under such circumstance, water cannot continue to flow into the reservoir as there will be no place for it to accumulate or escape. Valve assembly 10 will thereby effectively prevent a damaged bottle from allowing its contents to overflow the reservoir.

Figure 4:
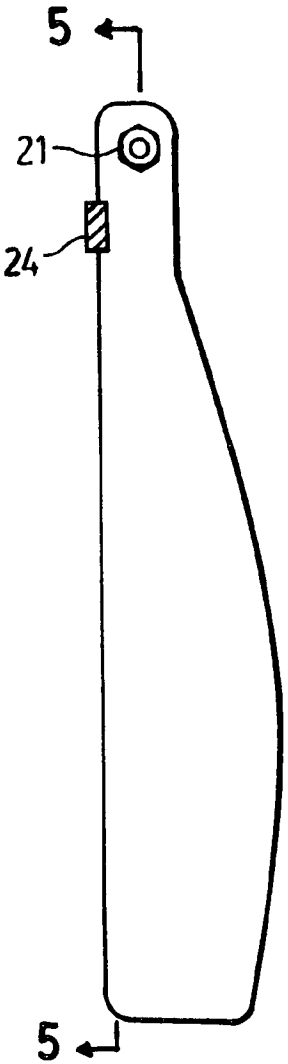
FIG. 4 is a side view of a float ring in accordance with one preferred embodiment of the present invention.
Figure 5:
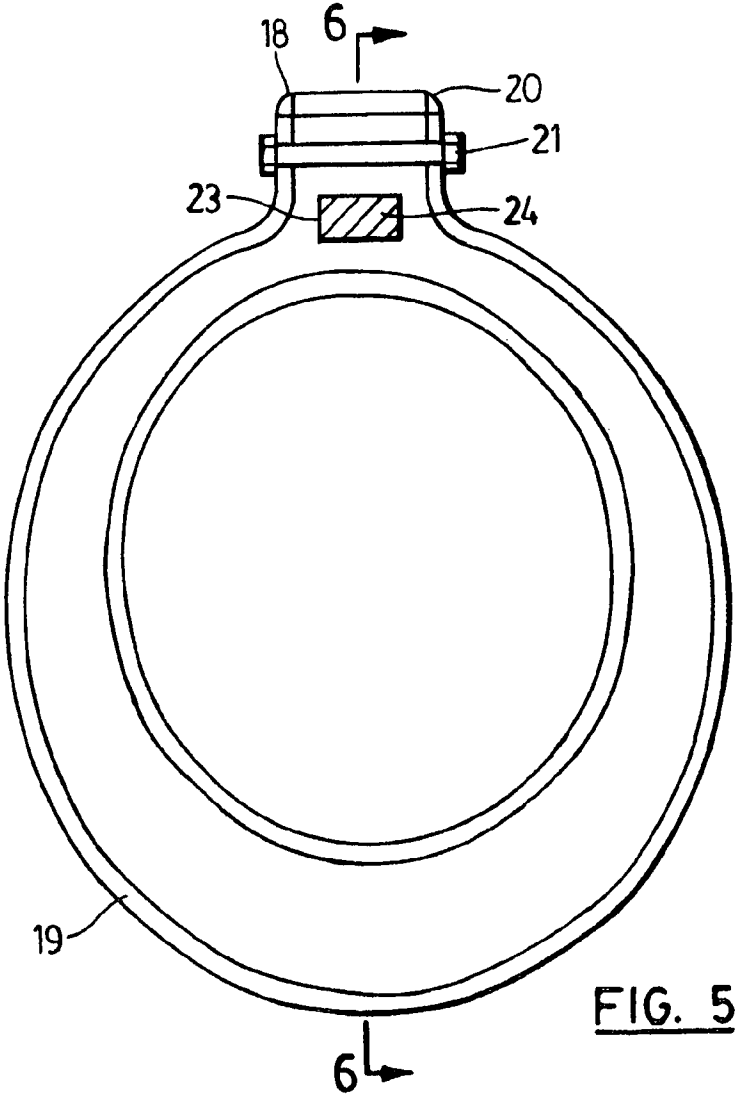
FIG. 5 is a sectional view taken along the line 5-5 of FIG. 4.
Figure 6:
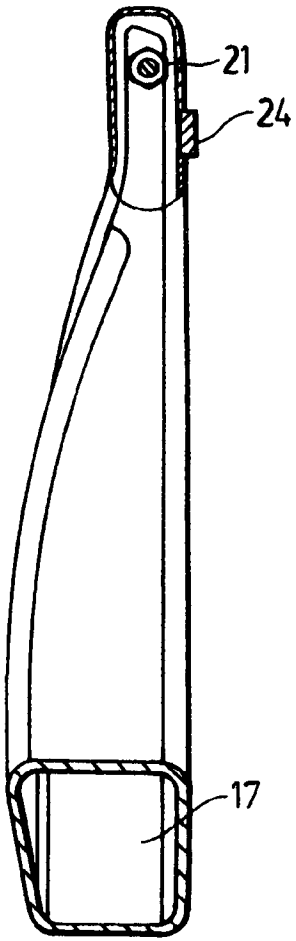
FIG. 6 is a sectional view taken along the line 6-6 of FIG. 5.

In the particular embodiment of the invention shown in the attached drawings, actuator arm 12 is comprised of a sealed and generally hollow body 17 that floats upon the surface of the water stored in the reservoir. For ease of manufacturing, and in an attempt to maximize the buoyancy of actuator arm 12, the arm may be formed in the shape of an enclosed polygon which, as indicated in FIGS. 4, 5 and 6, may have the general shape of a circular floating ring. It is also expected that most instances arm 12 would be moulded from a plastic material.

Figure 8:
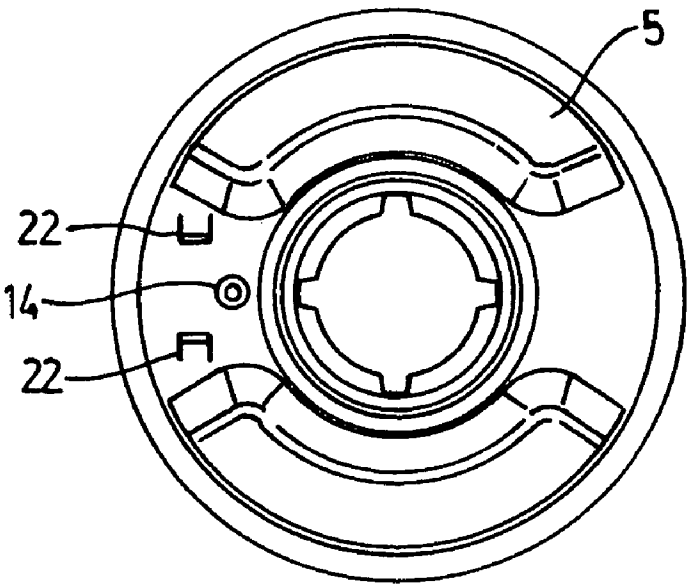
FIG. 8 is a bottom view of the water bottle adapter of the water cooler shown in FIG. 2.
Figure 7:
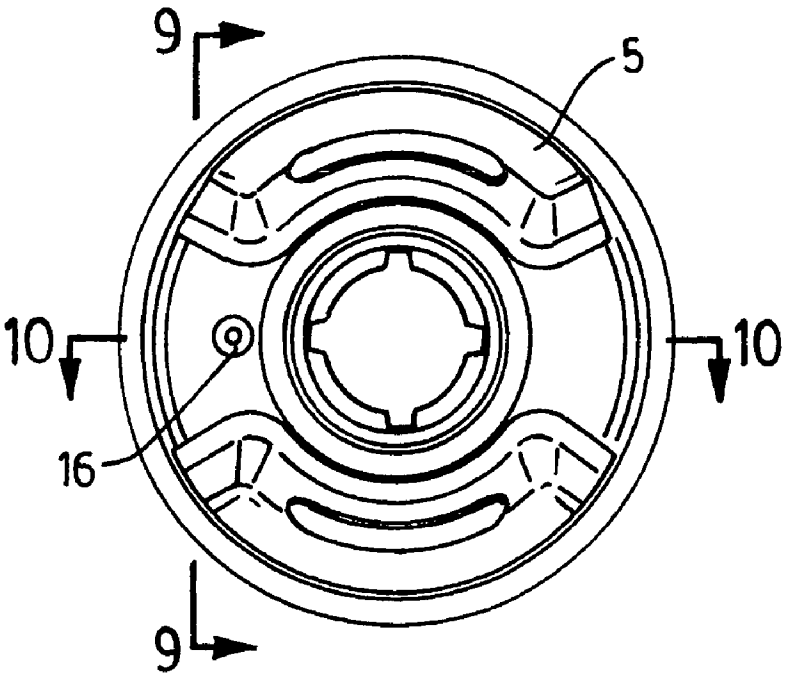
FIG. 7 is a top plan view of the water bottle adaptor of the water cooler shown in FIG. 2.
Figure 9:
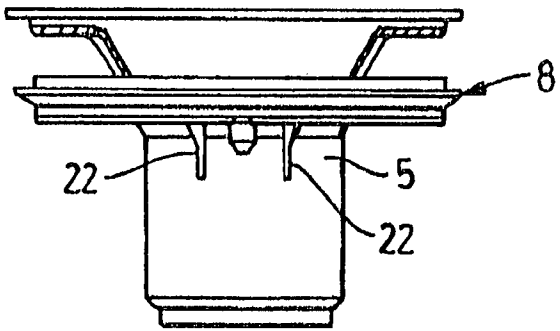
FIG. 9 is a sectional view taken along the line 9-9 of FIG. 7.

Referring to FIGS. 4, 5 and 6, in the embodiment of the invention that is shown actuator arm 12 is of a generally circular configuration having a first portion 18 that is hingedly secured within reservoir 4, and a second portion 19 that effectively serves to function as float 13. First portion 18 comprises an outwardly extending and generally rectangular support flange 20. Lying in a plane that is generally perpendicular to the axis of arm 12, and passing through support member 20, is a pin or axle 21 about which actuator arm 12 pivots. Axle 21 engages a pair of lugs 22 extending downwardly from the lower surface of water bottle adapter 5 adjacent to ventilation passageway 11 (see FIGS. 2, 8 and 9). Axle 21 and lugs 22 thus effectively secure actuator arm 12 to water bottle adapter 5 and present a hinged connection about which the actuator arm may be caused to rotate with fluctuations in the water level within the reservoir. While in this embodiment actuator arm 12 is hingedly secured to water bottle adapter 5, those skilled in the art will appreciate that the actuator arm could equally be hingedly secured to the inner wall of the reservoir.

By means of the described manner of securing actuator arm 12 to water cooler 1, it will be understood that a rise in the water level within the reservoir will cause the arm to pivot upwardly about axle 21 until such time as the upper surface 23 of arm 12 comes into contact with lower end 14 of ventilation passageway 11. At the initial point of contact a preliminary seal will be formed between arm 12 and ventilation passageway 11. In the event that the seal does not fully and completely prevent the movement of air through the passageway into reservoir 4, the water level within the reservoir will continue to rise causing actuator arm 12 to rotate further in a generally upward direction. This further upward movement of actuator arm 12 will cause the application of a torsional force upon axle 21 and a compressive force between surface 23 and lower end 14 of ventilation passageway 11. The shape and configuration of actuator arm 12, and the fact much of the arm is offset from its point of contact with ventilation passageway 11, results in hollow body 17 effectively becoming a moment arm. The amount of force that can be applied between upper surface 23 and lower end 14 of ventilation passageway 11 will therefore be enhanced due to the application of force (through the buoyancy of arm 12) at a distance from passageway 11 and from axle 21 about which arm 12 pivots.

To help ensure a high integrity seal between surface 23 of actuator arm 12 and lower end 14 of ventilation passageway 11, both the lower end of the passageway and at least the portion of upper surface 23 that bears against lower end 14 may be formed or machined such that they have a flat and relatively smooth surface. In this manner when the two surfaces meet they will effectively block the flow of air or fluids through the passageway. As a means to increase the seal between ventilation passageway 11 and actuator arm 12, the lower end 14 of the ventilation passageway may also be tapered to reduce its cross-sectional area. This will have the effect of concentrating the force applied between the actuator arm and lower end 14 over a smaller area and enhance the seal therebetween.

Figure 11:
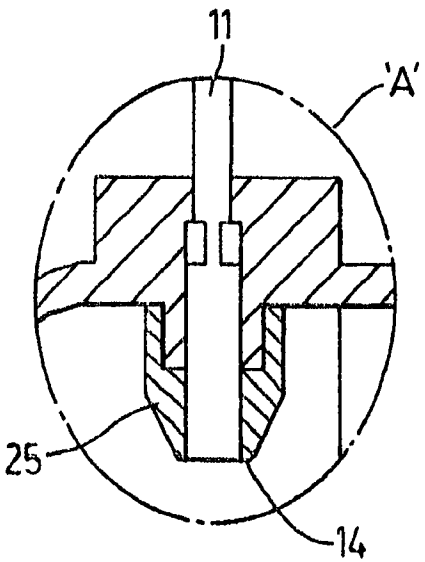
Figure 10:
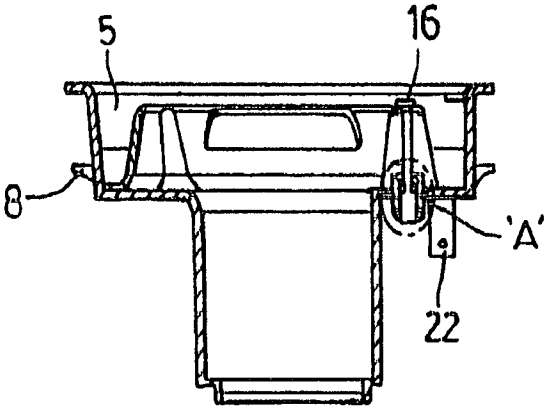
FIG. 10 is a sectional view taken along the line 10-10 of FIG. 6 and depicting an alternate embodiment of the present invention; and, FIG. 11 is an enlarged detail view of portion "A" shown in FIG. 10.

In an alternate embodiment the portion of upper surface 23 of actuator arm 12 that contacts lower end 14 of ventilation passageway 11 may have applied thereto a resilient compressible material 24 that acts as a sealing element and that is driven into contact with lower end 14 as arm 12 is rotated in a generally upward direction. The compressibility of material 24 will effectively cause it to deform about lower end 14 with a rise in the level of water within the reservoir, and increase the integrity of the seal. In a further alternate embodiment (see FIGS. 10 and 11) the lower end 14 of ventilation passageway 11 may have applied thereto a resilient compressible material 25 against which upper surface 23 of arm 12 is driven as the arm pivots in an upward direction. Compressible material 25 will effectively function in a similar manner as described above with respect to material 24. If desired valve assembly 10 may include both a resilient compressible material adhered to upper surface 23 of actuator arm 12 and a resilient compressible material placed about end 14 of ventilation passageway 11.

Through an understanding of the above described invention it will be appreciated and understood that automatic valve assembly 10 presents a number of very significant advantages over prior existing water cooler structures. First and foremost, valve assembly 10 provides a mechanism to positively control the flow of water from an inverted water bottle into a water cooler reservoir, and in particular to prevent the unintentional overflowing of the reservoir in instances where the bottle has developed a crack or hole through its exterior surface. Secondly, the structure of valve assembly 10 presents a mechanism by which a positive seal of the air passageway into the reservoir can be achieved, and a structure that increases the integrity of that seal as the water level in the reservoir rises. Thirdly, the hinged connection between the actuator arm of valve assembly 10 and the internal structural components of the water cooler ensures an accurate and proper positioning and placement of the sealing mechanism relative to the ventilation passageway. In this manner positioning the water cooler on a non-horizontal surface such that it is not perfectly upright will have no appreciable effect on the operation of the valve assembly. In addition, the valve assembly is not subject to becoming misaligned through normal movement of the water cooler during shipping and handling. Finally, the described structure of automatic valve assembly 10 presents an economical means of sealing the passage of air and fluids through the ventilation passageway when the reservoir is filled to a predetermined level.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A water cooler having a reservoir for receiving water from an inverted water bottle, said water cooler comprising:
(a) a ventilation passageway for air to enter said reservoir; and,
(b) an automatic valve assembly including a float, said float having an opening extending therethrough, said float being mounted within an interior of said water cooler and operable to move between an open and a closed position in response to changing water levels within said reservoir, when in said open position said float allowing the unrestricted passage of air into said reservoir through said ventilation passageway and when in said closed position said float restricting the flow of air and fluids through said ventilation passageway, said automatic valve assembly further including a sealing element disposed in said reservoir and moveable in response to movement of said float, when said float is in said open position said sealing element permitting air to flow through said ventilation passageway into said reservoir and when said float is in said closed position said sealing element preventing the passage of air through said ventilation passageway, said sealing element being comprised of a resilient compressible material that is driven into contact with said ventilation passageway upon movement of said float with a rise in the water level within said reservoir beyond a predetermined level such that a further rise in the water level within said reservoir causes said sealing element to be compressed about said ventilation passageway to restrict the passage of air therethrough.

2. A water cooler as set forth in claim 1, further including:
(a) a probe for engaging an inverted water bottle, said probe being configured such that water from the water bottle passes through said probe into said reservoir; and,
(b) said float surrounds said probe.

3. A water cooler as set forth in claim 2, further including:
(a) an adapter for sealing said reservoir, said adapter having an upper portion and a lower portion, said lower portion being disposed inwardly of said upper portion, said lower portion of said adapter is received in said opening of said float.

4. A water cooler as set forth in claim 1, further including:
(a) an adapter for sealing said reservoir, said adapter having an upper portion and a lower portion, said lower portion being disposed inwardly of said upper portion; and,
(b) said float surrounding said lower portion of said adapter.

5. A water cooler as set forth in claim 3, wherein:
(a) said adapter includes a circumferential lip; and,
(b) said float being disposed inwardly of an outermost surface of said circumferential lip.

6. A water cooler as set forth in claim 1, wherein;
(a) said sealing element is supported by said float.

7. A water cooler as set froth in claim 1, wherein:
(a) said float includes an upper surface, said sealing element abuts said upper surface of said float.

8. A water cooler as set forth in claim 1, wherein:
(a) said float is generally circular.

9. A water cooler as set forth in claim 1, wherein:
(a) said float is hingedly mounted.

10. A water cooler having a reservoir for receiving water from an inverted water bottle, said water cooler comprising:
(a) a ventilation passageway for air to enter said reservoir; and,
(b) an automatic valve assembly including a float, said float having an opening extending therethrough, said float being mounted within an interior of said water cooler and operable to move between an open and a closed position in response to changing water levels within said reservoir, when in said open position said float allowing the unrestricted passage of air into said reservoir through said ventilation passageway and when in said closed position said float restricting the flow of air and fluids through said ventilation passageway, said automatic valve assembly further including a sealing element disposed in said reservoir and moveable in response to movement of said float, when said float is in said open position said sealing element permitting air to flow through said ventilation passageway into said reservoir and when said float is in said closed position said sealing element preventing the passage of air through said ventilation passageway, said sealing element being comprised of a resilient compressible material that is driven into contact with said ventilation passageway upon movement of said float with a rise in the water level within said reservoir beyond a predetermined level such that a further rise in the water level within said reservoir causes said sealing element to be compressed about said ventilation passageway to restrict the passage of air therethrough; and, (c) an adapter for sealing said reservoir, said adapter having an upper portion and a lower portion, said lower portion being disposed inwardly of said upper portion, said lower portion of said adapter is received in said opening of said float.

11. A water cooler as set forth in claim 10, further including:

(a) a probe for engaging an inverted water bottle, said probe being configured such that water from the water bottle passes through said probe into said reservoir; and, (b) said float surrounds said probe.

12. A water cooler as set forth in claim 11, wherein:

(a) said probe extends into said lower portion of said adapter.

13. A water cooler as set forth in claim 12, wherein:

(a) said float extends across said probe.

14. A water cooler as set forth in claim 10, wherein:

(a) said adapter includes a circumferential lip; and, (b) said float is disposed inwardly of an outermost surface of said circumferential lip.

15. A water cooler as set forth in claim 14, wherein:

(a) said float extends across said lower portion of said adapter.

16. A water cooler as set forth in claim 10, wherein;

(a) said sealing element is supported by said float.

17. A water cooler as set forth in claim 10, wherein:

(a) said float is hingedly mounted.

18. A water cooler having a reservoir for receiving water from an inverted water bottle, said water cooler comprising:

(a) a ventilation passageway for air to enter said reservoir; and, (b) an automatic valve assembly including a float, said float being mounted within an interior of said water cooler and operable to move between an open and a closed position in response to changing water levels within said reservoir, when in said open position said float allowing the unrestricted passage of air into said reservoir through said ventilation passageway and when in said closed position said float restricting the flow of air and fluids through said ventilation passageway, said automatic valve assembly further including a sealing element disposed in said reservoir and moveable in response to movement of said float, when said float is in said open position said sealing element permitting air to flow through said ventilation passageway into said reservoir and when said float is in said closed position said sealing element preventing the passage of air through said ventilation passageway, said sealing element being comprised of a resilient compressible material that is driven into contact with said ventilation passageway upon movement of said float with a rise in the water level within said reservoir beyond a predetermined level such that a further rise in the water level within said reservoir causes said sealing element to be compressed about said ventilation passageway to restrict the passage of air therethrough;

(c) an adapter for sealing said reservoir, said adapter having an upper portion and a lower portion, said lower portion being disposed inwardly of said upper portion; and, (d) a probe for engaging an inverted water bottle, said probe being configured such that water from the water bottle passes through said probe into said reservoir, said probe extending into said lower portion of said adapter; and, (e) said float extending across said lower portion of said adapter, said float surrounds said probe and said lower portion of said adapter.

19. A water cooler as set forth in claim 18, wherein:

(a) said adapter includes a circumferential lip; and, (b) said float is disposed inwardly of an outermost surface of said circumferential lip.

20. A water cooler as set forth in claim 18, wherein:

(a) said float is hingedly mounted.

21. A water cooler having a reservoir for receiving water from an inverted water bottle, said water cooler comprising:

(a) an opening for air to enter said reservoir; and, (b) an automatic valve assembly including a float, said float having an opening extending therethrough, said float being mounted within an interior of said water cooler and operable to move between an open and a closed position in response to changing water levels within said reservoir, when in said open position said float allowing the passage of air into said reservoir through said opening and when in said closed position said float restricting the flow of air and fluids through said opening, said automatic valve assembly further including a sealing element moveable in response to movement of said float, when said float is in said open position said sealing element permitting air to flow through said opening into said reservoir and when said float is in said closed position said sealing element preventing the passage of air through said opening; and, (c) an adapter for sealing said reservoir, said adapter having an upper portion and a lower portion, said lower portion being disposed inwardly of said upper portion, said lower portion of said adapter is received in said opening of said float.

22. A water cooler as set forth in claim 21, further including:

(a) a probe for engaging an inverted water bottle, said probe being configured such that water from the water bottle passes through said probe into said reservoir; and, (b) said float surrounds said probe.

23. A water cooler as set forth in claim 22, wherein:

(a) said probe extends into said lower portion of said adapter.

24. A water cooler as set forth in claim 21, wherein:

(a) said sealing element is comprised of a resilient compressible material.

25. A water cooler as set forth in claim 21, wherein:

(a) said float is hingedly mounted.

* * * * *